US009179791B2

(12) United States Patent
Aspera

(10) Patent No.: US 9,179,791 B2
(45) Date of Patent: Nov. 10, 2015

(54) RETRACTABLE ARMS CLOTHES HANGER

(71) Applicant: Alan Mark Aspera, Wahiawa, HI (US)

(72) Inventor: Alan Mark Aspera, Wahiawa, HI (US)

( * ) Notice: Subject to any disclaimer, the term of this patent is extended or adjusted under 35 U.S.C. 154(b) by 92 days.

(21) Appl. No.: 14/147,576

(22) Filed: Jan. 5, 2014

(65) Prior Publication Data

US 2015/0190005 A1 Jul. 9, 2015

(51) Int. Cl.
*A47G 25/40* (2006.01)
*A47F 7/19* (2006.01)

(52) U.S. Cl.
CPC . *A47G 25/40* (2013.01); *A47F 7/19* (2013.01); *A47G 25/4023* (2013.01)

(58) Field of Classification Search
CPC ..... A47G 25/20; A47G 25/30; A47G 25/40; A47G 25/442; A47G 25/443; A47G 25/4015; A47G 25/4023; A47F 7/19; A41D 27/22
USPC ..... 223/85, 89, 94, 98
See application file for complete search history.

(56) References Cited

U.S. PATENT DOCUMENTS 1,970,943 A * 8/1934 Raymond ..... 223/94
5,102,019 A * 4/1992 Lam ..... 223/94
6,149,038 A * 11/2000 Tsai ..... 223/86
7,694,859 B1 * 4/2010 Whittaker ..... 223/94
8,235,261 B1 * 8/2012 Park et al. ..... 223/94
2006/0054646 A1 * 3/2006 Nathanmanna ..... 223/89
2011/0284597 A1 * 11/2011 Kaleta et al. ..... 223/85

FOREIGN PATENT DOCUMENTS

DE 19860605 A1 * 7/2000
FR 989901 A * 9/1951

* cited by examiner

*Primary Examiner* — Isamel Izaguirre
(74) *Attorney, Agent, or Firm* — Chen-Chi Lin

(57) ABSTRACT

The disclosed retractable arms clothes hanger is designed to allow it to be easily inserted into and removed from the neck opening of a tee shirt, pullover, buttoned down shirt, or turtleneck sweater when its arms are retracted in the down position. Once inserted, the turning knob of the retractable arms clothes hanger can be rotated so the arms can be extended into their rigid, upwardly extended position thereby preventing unnecessary garment stretching. By rotating the turning knob of the retractable arms clothes hanger in the opposite direction, the arms of the retractable arms clothes hanger can be retracted back to its down position. The retractable arms clothes hanger with its arms in the down position can be easily and conveniently stored when not in use. The arms of the retractable arms clothes hanger can be fully adjusted to correspond to the proper angle of any type of garment.

6 Claims, 10 Drawing Sheets

RETRACTABLE ARMS CLOTHES HANGER

CROSS-REFERENCE TO RELATED APPLICATION

This application claims the benefit of U.S. provisional patent application 61/749,689 filed on Jan. 7, 2013 by the present inventor.

BACKGROUND OF THE INVENTION

The following is a tabulation of some prior art that presently appears relevant:

| U.S. Patents | | |
|---|---|---|
| Patent Number | Issue Date | Patentee |
| 5,480,076 | Jan. 2, 1996 | Siegel/Ganaja |
| 8,235,261 | Aug. 7, 2012 | Park/Kim |
| 8,459,514 | Jun. 11, 2013 | Lagzdins |
| 8,517,232 | Aug. 27, 2013 | Geltzer/Ciaglia |

Conventional clothes hangers are generally designed with a center section having rigid arms that extend outward and are angled downward from the center section. Projecting upwardly from the center section is a suspension hook that allows the hanger to be hung from a horizontal pole or other protuberance. The conventional clothes hangers are suited for hanging most garments that have a large neck opening such as on front opening coats and shirts. However, when a narrow necked garment, such as a tee shirt, pullover, buttoned down shirt, or turtleneck sweater, is to be hung on a conventional clothes hanger, it is necessary to insert the hanger up through the bottom opening of the lower portion of the garment and into the garment's shoulder section to prevent the stretching of the collar area. In addition to conventional clothes hangers, the disclosed prior art also discloses several designs of retractable clothes hangers that have rigid arms that retract upwardly or downwardly. However, the disclosed invention differentiates itself from the disclosed prior art as it is the first type of retractable hanger that uses a turning knob that when rotated clockwise or counter-clockwise causes its hanger arms to move to an up position or down position.

The disclosed retractable arms clothes hanger is designed to allow it to be easily inserted into and removed from the neck opening of a tee shirt, pullover, buttoned down shirt, or turtleneck sweater when its hanger arms are retracted in the down position. Once inserted, the turning knob of the retractable arms clothes hanger can be rotated so its arms can be extended into their rigid, upwardly extended position thereby preventing unnecessary garment stretching. By rotating the turning knob in the opposite direction, the arms of the retractable arms clothes hanger can be retracted back to its down position. The retractable arms clothes hanger with its arms in the down position can be easily and conveniently stored when not in use, unlike conventional clothes hangers that take up more space and get easily tangled. Not all garments have the same shoulder angle, so the arms of the retractable arms clothes hanger can be fully adjusted to correspond to the proper angle of any type of garment.

SUMMARY OF THE INVENTION

The disclosed retractable arms clothes hanger uses a turning knob to move its hanger arms into an up or down position. When the retractable arms clothes hanger has its arms in the down position, it is easy to insert into or remove from the opening of the collar area of t-shirts or other garments with narrow neck openings. Once inserted, the turning knob of the retractable arms clothes hanger can be rotated so its arms can be extended into their rigid, upwardly extended position thereby preventing unnecessary garment stretching. By rotating the turning knob in the opposite direction, the arms of the retractable arms clothes hanger can be retracted back to its down position. This will prevent the collar area of those types of garments from stretching. This will save time because you will not have to unbutton and re-button shirts when using the retractable arms clothes hanger. It also saves time when using the retractable arms clothes hanger by not having to insert hangers from the bottom opening of garments with narrow neck openings. Even though you can rotate the turning knob of the retractable arms clothes hanger with little effort, the arms of the retractable arms clothes hanger lock tightly in place which allows it to hold heavy sweaters and jackets. The retractable arms clothes hanger with its arms in the down position makes it more convenient to travel with due to its compact size. The retractable arms clothes hanger with its arms in the down position would also take up less space and prevent tangling when placed in a storage container, unlike conventional clothes hangers. The hanger hook of the retractable arms clothes hanger is able to stay in place or move freely when rotating the turning knob of the retractable arms clothes hanger. This feature will allow the retractable arms clothes hanger to be operated with one hand while it's still hooked on the clothes line.

DETAILED DESCRIPTION OF THE DRAWINGS

Figure 1:
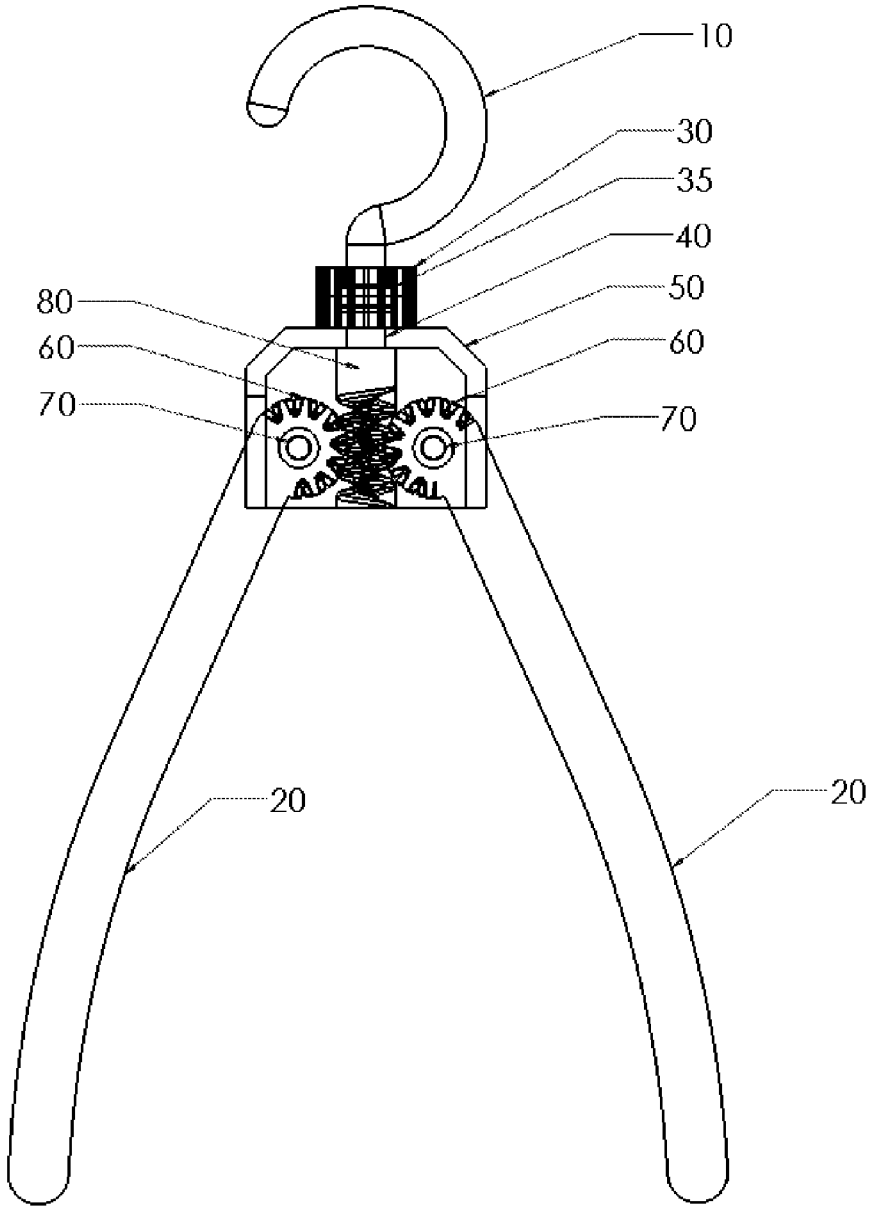
FIG. 1 shows a side view of the hanger with the hanger arms in the down position and a cut-away showing the internal structure.

FIG. 1. FIG. 1 shows a side view of the hanger with the hanger arms in the down position and a cut-away showing the internal structure. The hanger hook 10 provides a means to hang the hanger from a horizontal pole or other protuberance. The hanger hook 10 can stay in place or rotate freely independent from the rotation of the turning knob 30. The two hanger arms 20 may be retracted to a down position by rotating the turning knob 30 or retracted to an up position by rotating the turning knob 30 in the opposite direction. The hanger hook 10 is secured with the hanger hook swivel 35. The turning knob 30 and worm screw 80 piece is held in place by the outer casings 50 that secures around the worm screw axel 40. The two outer casings 50 each have two holes that connect through the hanger arm axels 70 which secures the hanger arm drive gears 60 of the hanger arms 20. The hanger arm drive gears 60 directly engage the worm screw 80. The rotation of the turning knob 30 turns the worm screw 80 which engages the hanger arm drive gears 60 which retracts the hanger arms 20 to an up or down position.

Figure 2:
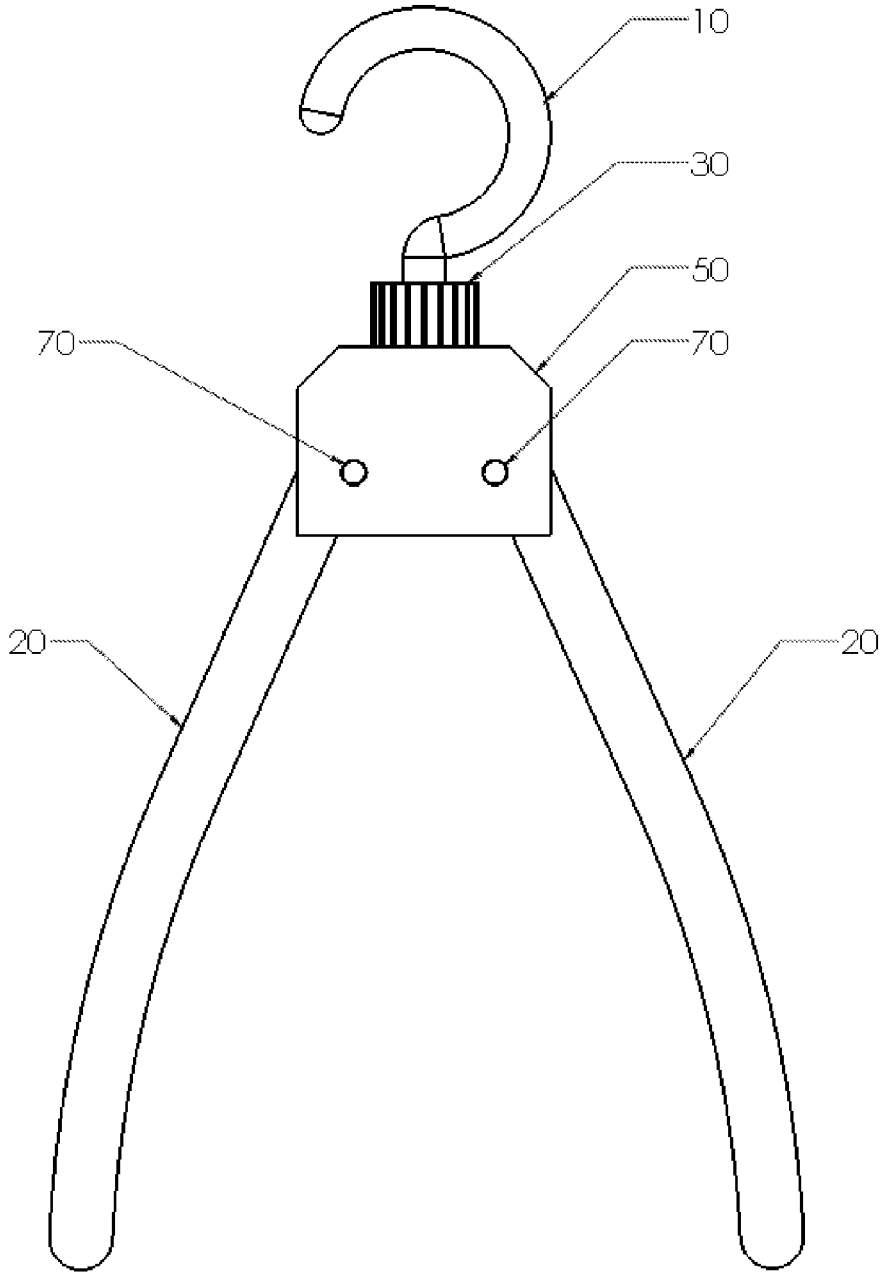
FIG. 2 shows a side view of the hanger with the hanger arms in the down position.

FIG. 2. FIG. 2 shows a side view of the hanger with the hanger arms in the down position. The hanger hook 10 provides a means to hang the hanger from a horizontal pole or other protuberance. The hanger hook 10 can stay in place or rotate freely independent from the rotation of the turning knob 30. The two hanger arms 20 may be retracted to a down position by rotating the turning knob 30 or retracted to an up position by rotating the turning knob 30 in the opposite direction. The hanger hook 10 is secured with the hanger hook swivel 35. The turning knob 30 and worm screw 80 piece is held in place by the outer casings 50 that secures around the worm screw axel 40. The two outer casings 50 each have two holes that connect through the hanger arm axels 70 which secures the hanger arm drive gears 60 of the hanger arms 20. The hanger arm drive gears 60 directly engage the worm screw 80. The rotation of the turning knob 30 turns the worm screw 80 which engages the hanger arm drive gears 60 which retracts the hanger arms 20 to an up or down position.

Figure 3:
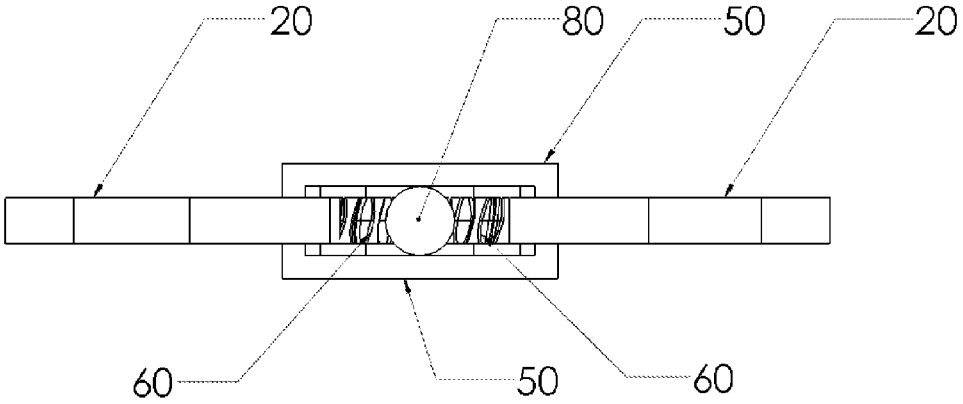
FIG. 3 shows a bottom view of the hanger with the hanger arms in the down position.

FIG. 3. FIG. 3 shows a bottom view of the hanger with the hanger arms in the down position. The two hanger arms 20 can be retracted by the clockwise or counter clockwise rotation of the worm screw 80 which causes the hanger arm drive gears 60 to raise and lower the hanger arms 20.

Figure 4:
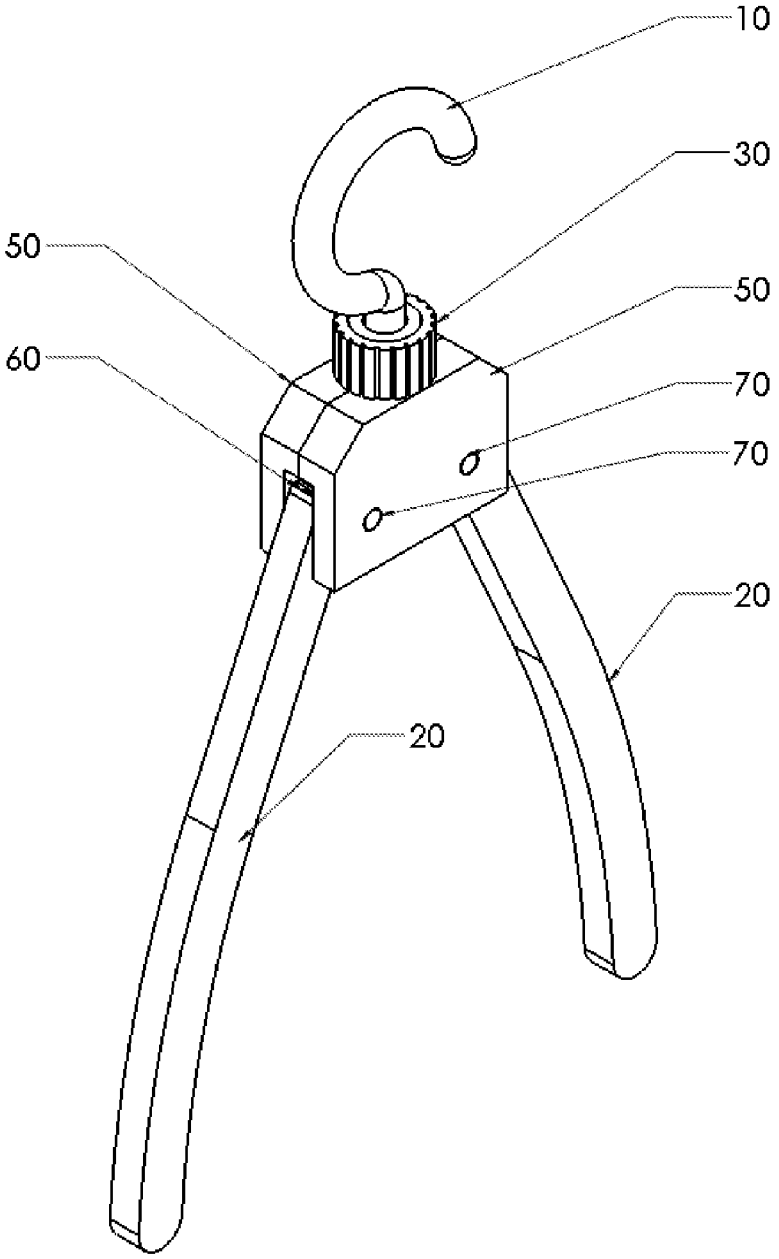
FIG. 4 shows a perspective top view of the hanger with the hanger arms in the down position.

FIG. 4. FIG. 4 shows a perspective top view of the hanger with the hanger arms in the down position. The hanger hook 10 provides a means to hang the hanger from a horizontal pole or other protuberance. The hanger hook 10 can stay in place or rotate freely independent from the rotation of the turning knob 30. The two hanger arms 20 may be retracted to a down position by rotating the turning knob 30 or retracted to an up position by rotating the turning knob 30 in the opposite direction. The hanger hook 10 is secured with the hanger hook swivel 35. The turning knob 30 and worm screw 80 piece is held in place by the outer casings 50 that secures around the worm screw axel 40. The two outer casings 50 each have two holes that connect through the hanger arm axels 70 which secures the hanger arm drive gears 60 of the hanger arms 20. The hanger arm drive gears 60 directly engage the worm screw 80. The rotation of the turning knob 30 turns the worm screw 80 which engages the hanger arm drive gears 60 which retracts the hanger arms 20 to an up or down position.

Figure 5:
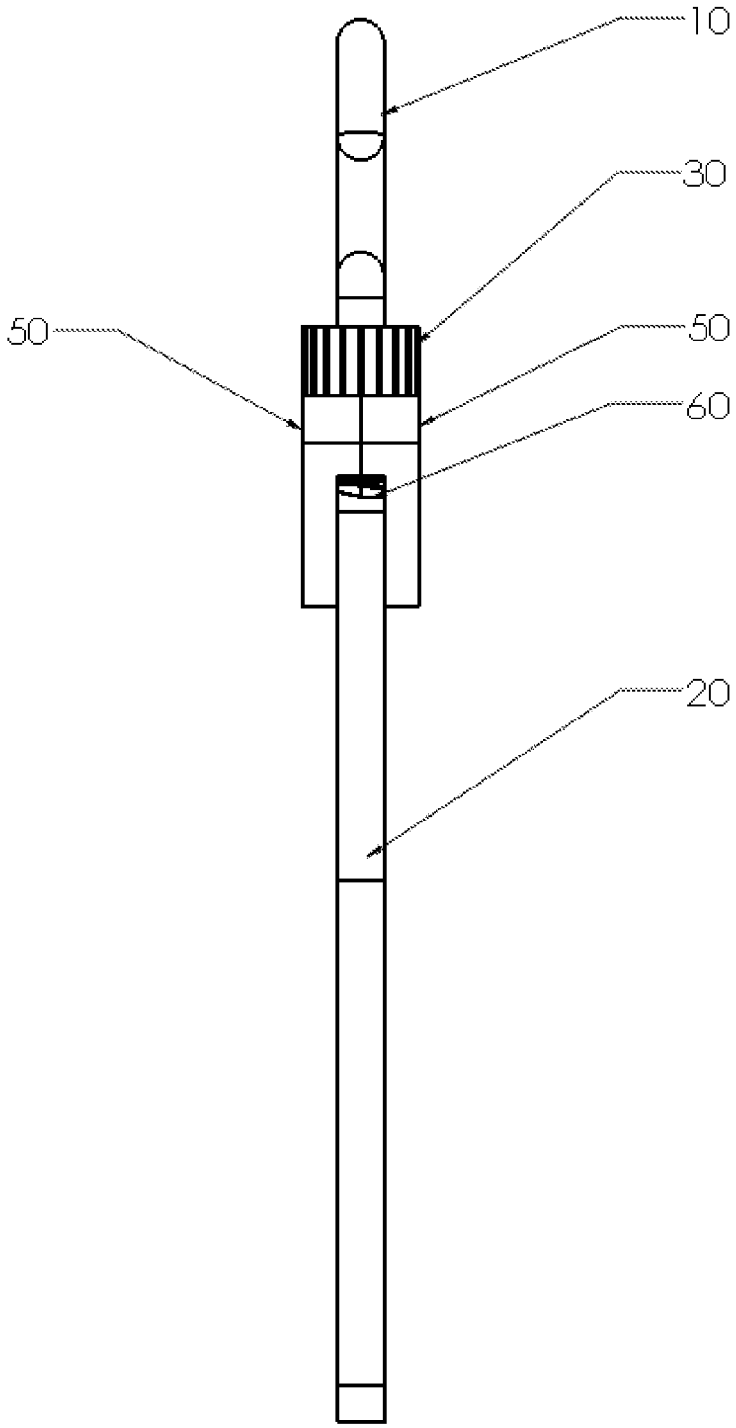
FIG. 5 shows a side view of the hanger with the hanger arms in the down position.

FIG. 5. FIG. 5 shows a side view of the hanger with the hanger arms in the down position. The hanger hook 10 provides a means to hang the hanger from a horizontal pole or other protuberance. The hanger hook 10 can stay in place or rotate freely independent from the rotation of the turning knob 30. The two hanger arms 20 may be retracted to a down position by rotating the turning knob 30 or retracted to an up position by rotating the turning knob 30 in the opposite direction. The hanger hook 10 is secured with the hanger hook swivel 35. The turning knob 30 and worm screw 80 piece is held in place by the outer casings 50 that secures around the worm screw axel 40. The two outer casings 50 each have two holes that connect through the hanger arm axels 70 which secures the hanger arm drive gears 60 of the hanger arms 20. The hanger arm drive gears 60 directly engage the worm screw 80. The rotation of the turning knob 30 turns the worm screw 80 which engages the hanger arm drive gears 60 which retracts the hanger arms 20 to an up or down position.

Figure 6:
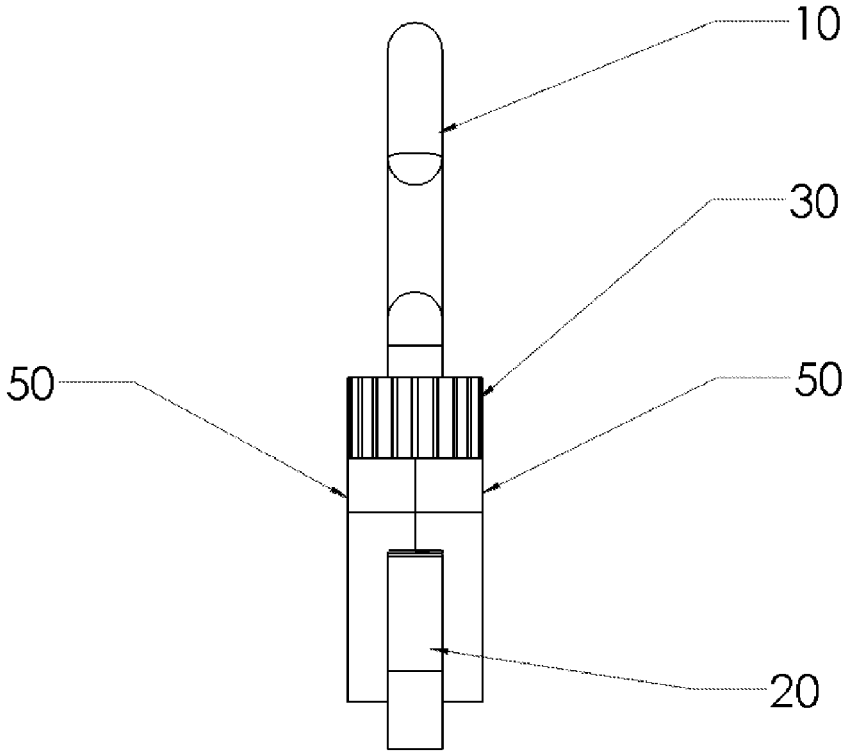
FIG. 6 shows a side view of the hanger with the hanger arms in the up position.

FIG. 6. FIG. 6 shows a close up side view of the hanger with the hanger arms in the up position. The hanger hook 10 provides a means to hang the hanger from a horizontal pole or other protuberance. The hanger hook 10 can stay in place or rotate freely independent from the rotation of the turning knob 30. The two hanger arms 20 may be retracted to a down position by rotating the turning knob 30 or retracted to an up position by rotating the turning knob 30 in the opposite direction. The two outer casings 50 each have to holes that connect through the hanger arm axels 70 which secures the hanger arm drive gears 60 of the hanger arms 20.

Figure 7:
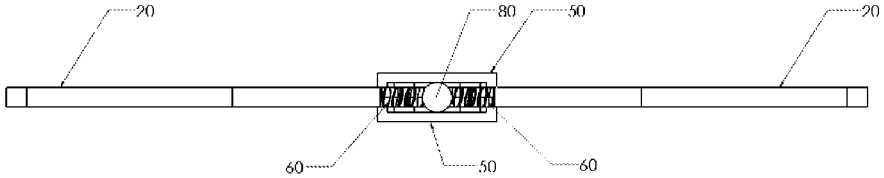
FIG. 7 shows a bottom view of the hanger with the hanger arms in the up position.

FIG. 7. FIG. 7 shows a bottom view of the hanger with the hanger arms in the up position. The two hanger arms 20 can be retracted by the clockwise or counter clockwise rotation of the worm screw 80 which engages the hanger arm drive gears 60 to raise and lower the hanger arms 20. The two outer casings 50 each have two holes that connect through the hanger arm axels 70 which secures the hanger arm drive gears 60 of the hanger arms 20.

Figure 8:
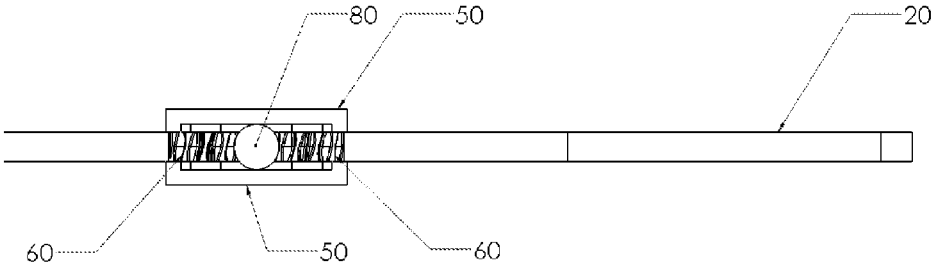
FIG. 8 shows a bottom view of half of the hanger view of the hanger with the hanger arms in the up position.

FIG. 8. FIG. 8 shows a bottom view of half of the hanger view of the hanger with the hanger arms in the up position. The two hanger arms 20 can be retracted by the clockwise or counter clockwise rotation of the worm screw 80 which causes the hanger arm drive gears 60 to raise and lower the hanger arms 20. The two outer casings 50 each have two holes that connect through the hanger arm axels 70 which secures the hanger arm drive gears 60 of the hanger arms 20.

Figure 9:
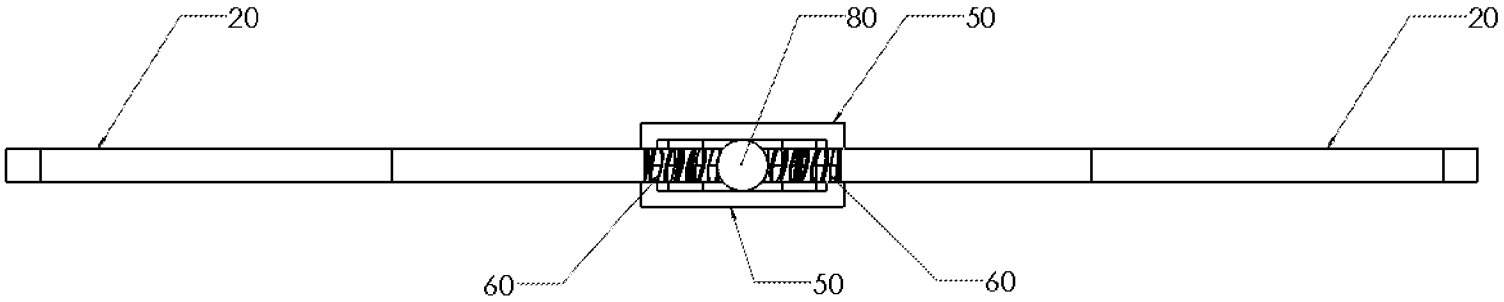
FIG. 9 shows a landscape view of the bottom view of the hanger with the hanger arms in the up position.

FIG. 9. FIG. 9 shows a landscape view of the bottom view of the hanger with the hanger arms in the up position. The two hanger arms 20 can be retracted by the clockwise or counter clockwise rotation of the worm screw 80 which engages the hanger arm drive gears 60 to raise and lower the hanger arms 20. The two outer casings 50 each have two holes that connect through the hanger arm axels 70 which secures the hanger arm drive gears 60 of the hanger arms 20.

Figure 10:
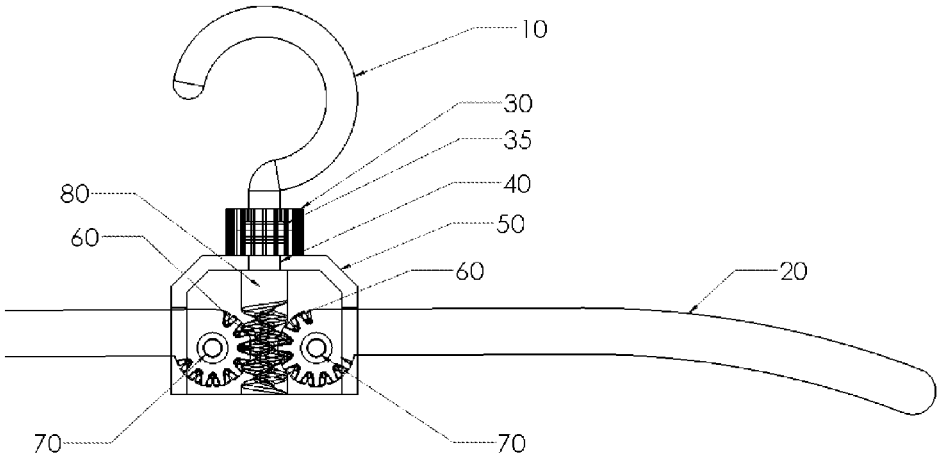
FIG. 10 shows a side view of about half of the hanger with the hanger arms in the up position and a cut-away showing the internal structure

FIG. 10. FIG. 10 shows a side view of about half of the hanger with the hanger arms in the up position and a cut-away showing the internal structure. The hanger hook 10 provides a means to hang the hanger from a horizontal pole or other protuberance. The hanger hook 10 can stay in place or rotate freely independent from the rotation of the turning knob 30. The two hanger arms 20 may be retracted to a down position by rotating the turning knob 30 or retracted to an up position by rotating the turning knob 30 in the opposite direction. The hanger hook 10 is secured with the hanger hook swivel 35. The turning knob 30 and worm screw 80 piece is held in place by the outer casings 50 that secures around the worm screw axel 40. The two outer casings 50 each have two holes that connect through the hanger arm axels 70 which secures the hanger arm drive gears 60 of the hanger arms 20. The hanger arm drive gears 60 directly engage the worm screw 80. The rotation of the turning knob 30 turns the worm screw 80 which engages the hanger arm drive gears 60 which retracts the hanger arms 20 to an up or down position.

Figure 11:
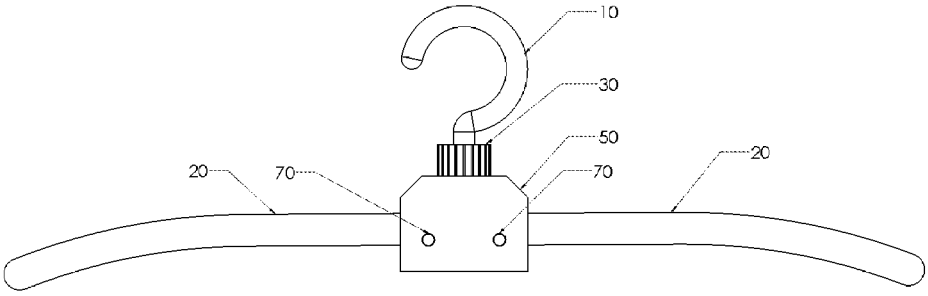
FIG. 11 shows a side view of the hanger with the hanger arms in the up position.

FIG. 11. FIG. 11 shows a side view of the hanger with the hanger arms in the up position. The hanger hook 10 provides a means to hang the hanger from a horizontal pole or other protuberance. The hanger hook 10 can stay in place or rotate freely independent from the rotation of the turning knob 30. The two hanger arms 20 may be refracted to a down position by rotating the turning knob 30 or retracted to an up position by rotating the turning knob 30 in the opposite direction. The hanger hook 10 is secured with the hanger hook swivel 35. The turning knob 30 and worm screw 80 piece is held in place by the outer casings 50 that secures around the worm screw axel 40. The two outer casings 50 each have two holes that connect through the hanger arm axels 70 which secures the hanger arm drive gears 60 of the hanger arms 20. The hanger arm drive gears 60 directly engage the worm screw 80. The rotation of the turning knob 30 turns the worm screw 80 which engages the hanger arm drive gears 60 which retracts the hanger arms 20 to an up or down position.

Figure 12:
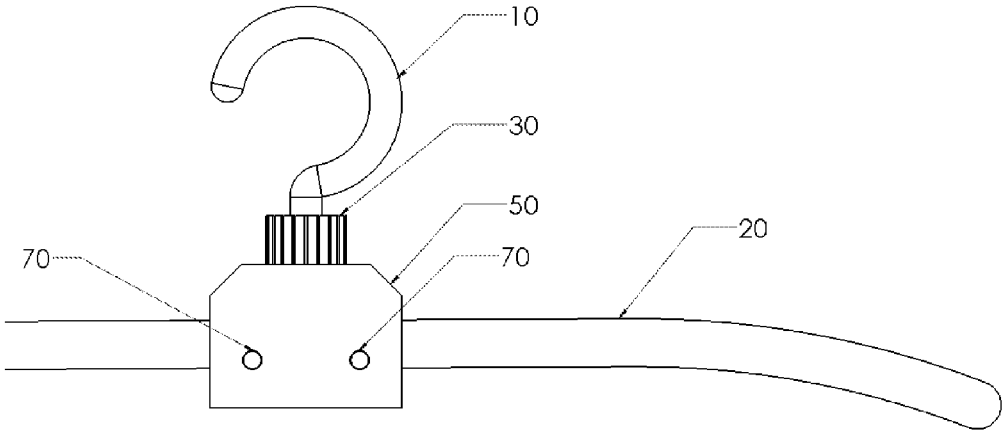
FIG. 12 shows a side view of about half of the hanger with the hanger arms in the up position.

FIG. 12. FIG. 12 shows a side view of about half of the hanger with the hanger arms in the up position. The hanger hook 10 provides a means to hang the hanger from a horizontal pole or other protuberance. The hanger hook 10 can stay in place or rotate freely independent from the rotation of the turning knob 30. The two hanger arms 20 may be retracted to a down position by rotating the turning knob 30 or retracted to an up position by rotating the turning knob 30 in the opposite direction. The hanger hook 10 is secured with the hanger hook swivel 35. The turning knob 30 and worm screw 80 piece is held in place by the outer casings 50 that secures around the worm screw axel 40. The two outer casings 50 each have two holes that connect through the hanger arm axels 70 which secures the hanger arm drive gears 60 of the hanger arms 20. The hanger arm drive gears 60 directly engage the worm screw 80. The rotation of the turning knob 30 turns the worm screw 80 which engages the hanger arm drive gears 60 which retracts the hanger arms 20 to an up or down position.

DETAILED DESCRIPTION OF THE PREFERRED EMBODIMENT

An objective of the present invention is to provide a retractable arms clothes hanger in order to solve some of the problems of the prior art.

An embodiment of the subject retractable hanger is disclosed in FIG. 1 through FIG. 12 wherein the retractable arms clothes hanger features retractable hanger arms 20 consisting of hanger arm drive gears 60 on each end consisting of hanger arm axels 70 which are secured by connecting through the holes of the outer casings 50. The rotating of the turning knob 30 causes the engaging of the worm screw 80 and the hanger arm drive gears 60 to invoke the desired upward or downward movement of the hanger arms 20. The embodiment shown features a design that may be readily fabricated utilizing the injection molding process with plastic, however other methods of manufacture may be utilized such as being made of wood. The hanger hook 10 may alternatively be made of metal and secured on top of the turning knob 30 which may eliminate the need to use a hanger hook swivel 35.

The disclosed subject matter offers improvements over prior art as it is the first type of retractable to make use of a turning knob 30 that when rotated clockwise or counterclockwise causes the hanger arms 20 to retract to a desired upward angle or downward angle. The retractable arms clothes hanger with its arms in the down position can be easily and conveniently stored when not in use, unlike conventional clothes hangers that take up more space and get easily tangled. Not all garments have the same shoulder angle, so the retractable hanger's arms can be fully adjusted to correspond to the proper angle of any type of garment The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been shown and described with reference to exemplary embodiments thereof, the present invention is not limited thereto, and it will be understood by those of ordinary skill in the art that various modifications and changes in form and details may be made therein without departing from the spirit or scope of the present invention as defined by the following claims.

What is claimed is:

1. A retractable arms clothes hanger comprising:

a) a turning knob with a worm screw to rotate clockwise or counter-clockwise so as to move a pair of hanger arms up or down;

b) a hanger arm drive gear on a first end of each of said pair of hanger arms, the hanger arm drive gear engaging with said worm screw of said turning knob;

c) a hanger arm axel located at the first end of said respective hanger arm drive gear on said pair of hanger arms;

d) an outer casing securing in place said turning knob and said worm screw; and e) a hanger hook;

wherein said outer casing secures said hanger arm drive gears of said hanger arms by connecting through said hanger arm axels; and wherein the hanger hook stays in place or rotates freely and independently from rotation of the turning knob.

2. A retractable arms clothes hanger comprising:

an outer casing;

a hanger hook swivel;

a hanger hook attached to the hanger hook swivel;

a turning knob to rotate about a first direction;

a worm screw to rotate about the first direction;

a worm screw axel interconnecting the turning knob and the worm screw, the worm screw axel being attached to the outer casing;

a first hanger arm having a first hanger arm drive gear at a first end of the first hanger arm;

a second hanger arm having a second hanger arm drive gear at a first end of the second hanger arm;

a first hanger arm axel interconnecting the first hanger arm drive gear and the outer casing; and a second hanger arm axel interconnecting the second hanger arm drive gear and the outer casing;

wherein the first and second hanger arm drive gears are engaged with the worm screw;

wherein the hanger hook stays in place or rotates freely and independently from rotation of the turning knob;

wherein the first and second hanger arms move up by rotating the turning knob about the first direction; and wherein the first and second hanger arms move down by rotating the turning knob about a second direction opposite the first direction.

3. A method for a user to utilize the retractable arms clothes hanger of claim 1, the method comprising:

hanging the hanger hook on a horizontal pole or a protuberance;

rotating the turning knob clockwise to move down the pair of hanger arms;

inserting the pair of hanger arms into a neck opening of a garment; and rotating the turning knob counterclockwise to move up the pair of hanger arms.

4. The method of claim 3, wherein the method is performed by a single hand of the user.

5. A method for a user to utilize the retractable arms clothes hanger of claim 2, the method comprising:

hanging the hanger hook on a horizontal pole or a protuberance;

rotating the turning knob about the first direction to move down the first and second hanger arms;

inserting the first and second hanger arms into a neck opening of a garment; and rotating the turning knob about the second direction to move up the first and second hanger arms.

6. The method of claim 5, wherein the method is performed by a single hand of the user.

* * * * *